US007438602B2

(12) United States Patent
Montgomery et al.

(10) Patent No.: US 7,438,602 B2
(45) Date of Patent: Oct. 21, 2008

(54) RUGGEDIZED USB PORT

(75) Inventors: James L Montgomery, Dubuque, IA (US); Jeffery R Kreiling, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/488,512

(22) Filed: Jul. 18, 2006

(65) Prior Publication Data

US 2008/0020633 A1 Jan. 24, 2008

(51) Int. Cl.
*H01R 24/04* (2006.01)

(52) U.S. Cl. ..... 439/638; 439/668; 439/551; 439/903

(58) Field of Classification Search ..... 439/554, 439/668, 676, 638, 551, 903
See application file for complete search history.

(56) References Cited

U.S. PATENT DOCUMENTS 5,822,427 A * 10/1998 Braitberg et al. ..... 379/454
6,573,683 B2 6/2003 Chang
6,612,875 B1 * 9/2003 Liao ..... 439/675
6,816,760 B1 11/2004 Namaky
6,842,356 B2 * 1/2005 Hsu ..... 363/146
6,844,846 B1 1/2005 Riday
6,936,936 B2 8/2005 Fischer et al.
7,121,850 B2 * 10/2006 Yeh ..... 439/131
7,121,897 B2 * 10/2006 Beski et al. ..... 439/668
2005/0227708 A1 * 10/2005 Peng ..... 455/456.1
2006/0052144 A1 * 3/2006 Seil et al. ..... 455/575.1

* cited by examiner

*Primary Examiner*—Neil Abrams
*Assistant Examiner*—Phuong Nguyen
(74) *Attorney, Agent, or Firm*—Baker & Daniels LLP

(57) ABSTRACT

The instant invention provides a robust USB connection configured to occupy the space heretofore utilized by a motor vehicle cigarette lighter. The USB connection is designed to adapt the pin for pin connection between a standard USB pin configuration and a common electrical harness connection used on off road heavy equipment. The USB female portion of the adaptor is designed to be readily replaced with minimal disassembly and cost in anticipation of high wear rates on the USB pins in the severe heavy equipment environment.

20 Claims, 3 Drawing Sheets

RUGGEDIZED USB PORT

The present invention relates to USB port connections for motor vehicles, particularly for civil works, forest harvesting and agricultural equipment hereafter generalized as 'heavy equipment'.

The present state of the art of motor vehicle manufacture includes often one, and frequently more than one computerized control modules. Such modules control such functions as the engine, the emissions control systems, the powertrain, on automobiles, the automatic braking system and air bag deployment to name some of the computer controlled functions representative of the state of the art. Maintenance and repair of motor vehicles may require the transfer of real-time, or stored, data from one or more modules to diagnostic equipment, or for another purpose. The data processing industry established the Universal Serial Bus, (USB) as a connectivity standard for computerized devices.

USB connector objectives include robust physical connectors, one-way connectivity, meaning that the connectors may not be physically connected incorrectly. While robustness is an objective for USB connectors, robustness is a relative term. Robust in an office environment may be fragile in the environment where heavy equipment is employed. The advantages of USB connectivity nonetheless motivate toward use of USB connections in spite what may be a fragile connection in a heavy equipment environment.

The instant invention provides a more robust USB connection while recognizing that in a heavy use environment damage to connectors may be unavoidable. Further, the instant invention provides repairable USB connectors for use in a heavy use environment.

Manufacturers understandably desire to minimize alteration to vehicle designs. Addition of USB connections to motor vehicle interiors may result in re-design of dashboards or other vehicle components. The instant invention provides a robust USB connection for installation in vehicle dashboards without requiring dashboard redesign. Although cigarette smoking may be declining, vehicle manufacturers continue to include cigarette lighters in motor vehicles. Originally a feature on higher end automobiles, lighter connections now appear on heavy equipment. While use of lighter connections for the original purpose, to ignite cigarettes by means of a heated resistance heater continues, it is now popular to add additional lighter connections located for convenient access from several passenger locations in the vehicle wired for lower amperage use to power appliances such as cellular telephones, navigation and entertainment devices.

The location of the lighter connection provides a convenient location for a USB port. The complete plug for the larger class A USB connector has dimensions approximately 6 mm×16 mm. The connection portion of the connector has dimensions approximately 3 mm×12 mm. These dimensions are easily accommodated by the space required for the standard cigarette lighter connection, which has a circular barrel diameter of approximately 21 mm. The lighter connection depth of approximately 40 mm easily accommodates a typical USB class A male plug having the same approximate length. Dashboard openings to accommodate a cigarette lighter are generally ovoid in shape, preferably circular. The minor diameter, if any, of the ovoid is advantageously from 22 mm or larger. While cigarette lighters may often be located as a dashboard component, the location within a vehicle is not critical to the instant invention which may locate USB ports within cigarette lighter locations at a variety of locations within a vehicle.

There is presented a USB port connection, sized to make use of space that heretofore accommodated a female cigarette lighter power connection.

BRIEF DESCRIPTION OF THE DRAWINGS REPRESENTING AN EMBODIMENT OF THE INVENTION

Figure 1:
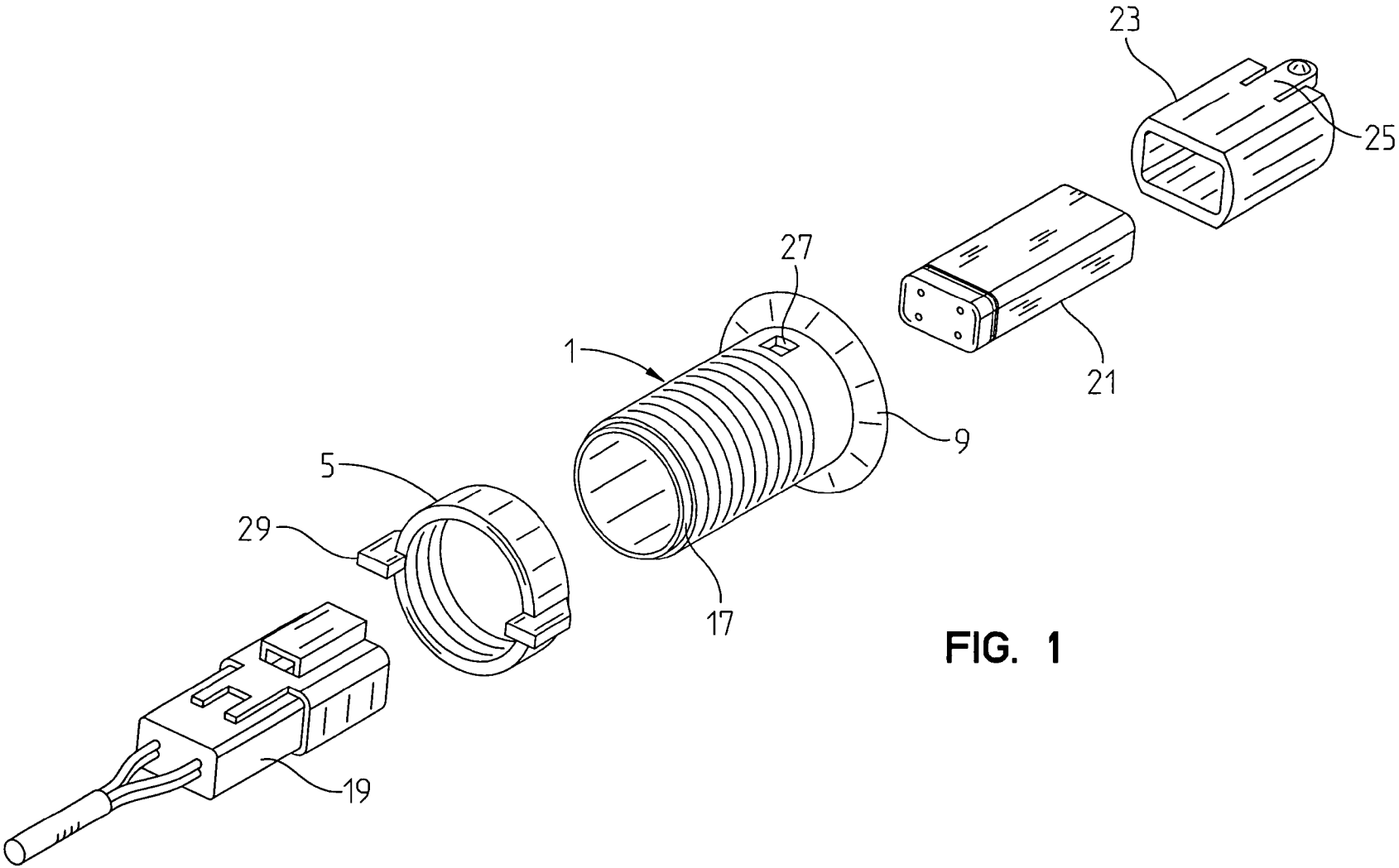
FIG. 1 represents an exploded view of an USB port sized for a cigarette lighter space.
Figure 2:
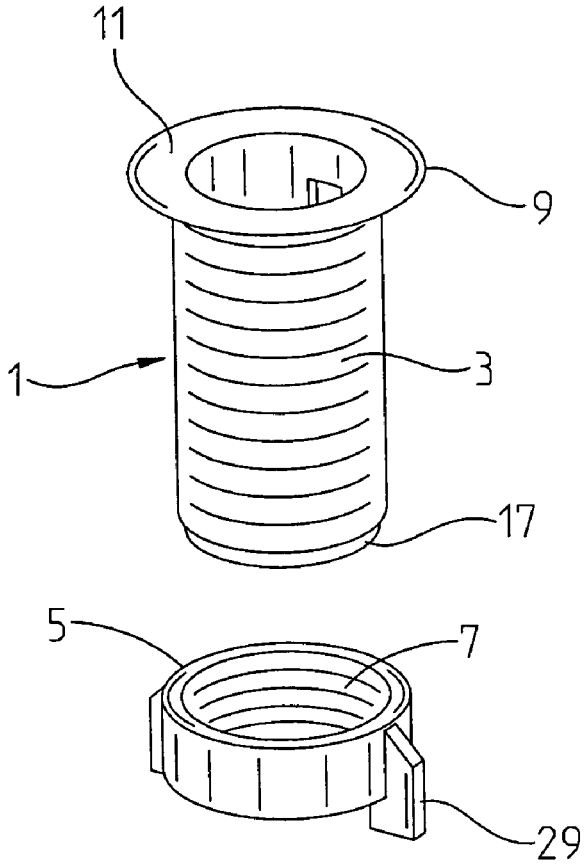
FIG. 2 represents a barrel and retainer for of an USB port assembly.

As illustrated in FIG. 1, the USB port comprises a barrel portion 1. The exterior of the barrel is threaded 3 (FIG. 2) to receive the nut portion 5 having internal threads 7 (FIG. 2) mated for the external threads of the barrel 3. The barrel has a flanged 9 first end 11 (FIG. 2).

As Installation of the illustrated embodiment of a USB port may be easily accomplished by inserting the barrel through an opening 13 sized to receive a cigarette lighter. The flanged 9 first end 11 is sized to hold the barrel on the outside (operator side) of a dashboard 15 or other support location.

Figure 4:
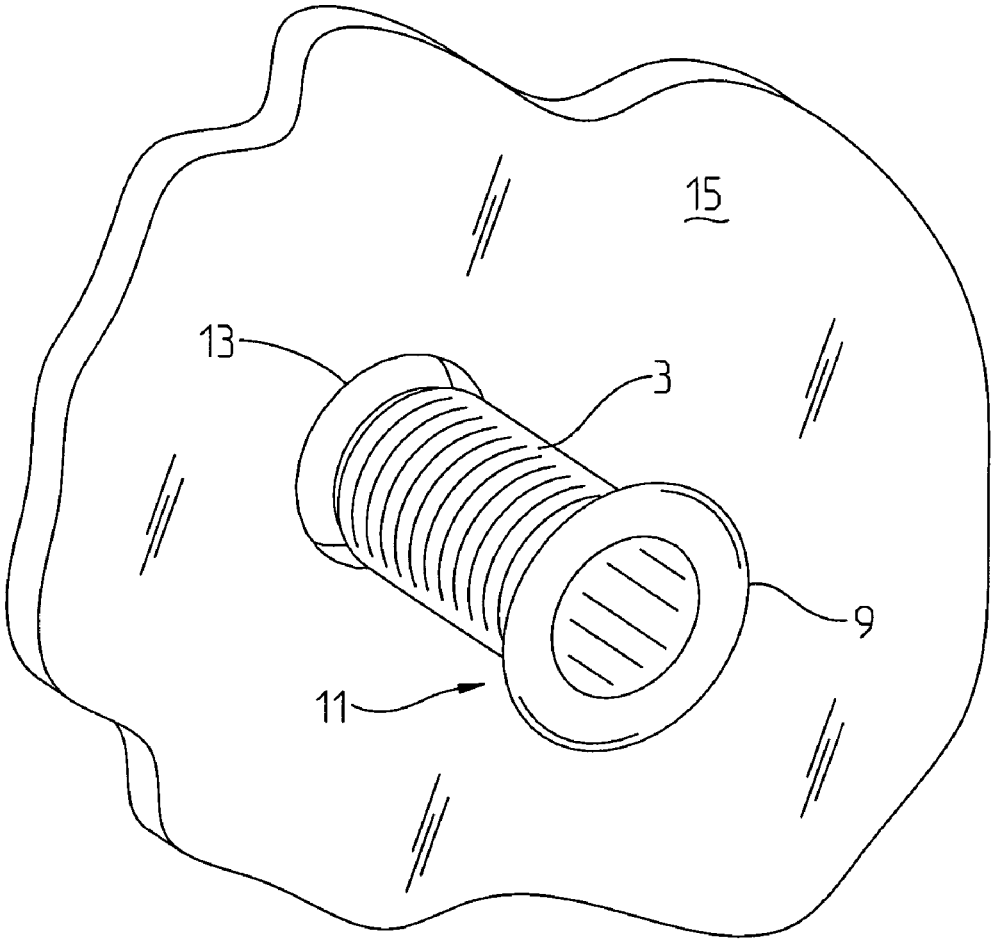
FIG. 4 illustrates a possible location for a USB port in a vehicle dashboard 15.

When threaded on the mating barrel threads 3, the nut 5 fastens the barrel into the opening 13 of the dashboard 15, as shown in FIG. 4.

The second barrel end 17 accommodates an electrical connection 19 for connecting the USB port to computer hardware on the motor vehicle. The motor vehicle hardware may connect a personal computer, or diagnostic computer, or specialized peripheral equipment to the motor vehicle functional modules, such as engine control module, emissions control module, powertrain control module, and such other control systems as are associated with vehicle operation. The USB port may transfer data from the vehicle hardware to connected peripheral devices. The USB port may also wired to serve as an antenna connection to provide wireless internet access for personal computers of vehicle occupants, or extra vehicular functions such as global positioning by means of triangulated satellite signals.

As shown in FIGS. 1 and 2, the nut 5 may optionally be configured with one or more retainer clips 29 to receive and fasten to connection 19 thus forming a unitary system of barrel, nut, and electrical connection. In one embodiment connection 19 has, within a cavity, electrical connection pins for connection to female USB connector 21. Within female USB connector 21 are electrical connections to transition from the pin configuration of electrical connector 19 and the standard electrical connection pattern of the USB male plug, not shown. A retainer clip 23 fits over the USB female connector 21. The retainer clip 23 may be configured to include a biased catch 25 oriented to joinably connect to an appropriately sized and oriented opening 27 in the barrel 1.

Figure 3:
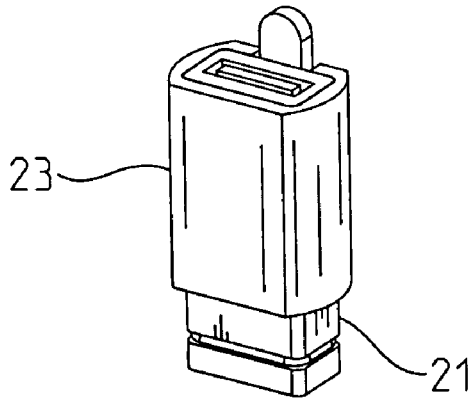
FIG. 3 represents a removable cartridge connector for an USB male plug.

FIG. 3 illustrates the combined female USB connector 21 and retainer 23. As the environment of use of heavy equipment may be considered somewhat severe, it may be anticipated that the USB connection within USB connector may fail over time. In anticipation the need for repair of the USB connector, and to minimize downtime and owner repair cost, the combined female USB connector 21 and retainer clip 23 may be conveniently removed from barrel by biasing the catch 25 to permit withdrawal of the combined female USB connector and retainer clip. As described, the combined USB connector 21 and retainer 23 comprise a plurality of components. The combination of components and functions in singular components is contemplated whereby the connector 21 and retainer 23 could comprise a single item.

The contact location of the USB port may be located near flange 9 resulting in the connection being situated near the surface to which the flange is drawn. Alternatively, the location of the USB port may be located within the barrel 1 depressed from 1 to 20 mm distally from the flange 9. When the USB connection is depressed, support for the male plug may be provided by the retainer 23. In a heavy equipment environment, where strong vibration may result during operation of a vehicle, support for the male USB plug will assist to prevent the vibration from loosing the plug from the connection in concert with the influence of gravity.

The connections and components described herein may be conveniently manufactured from well known thermoplastic materials such as polyolefins, polyamides, and thermoplastic composite materials such as glass filled polyolefins and glass filled polyamides by well known injection molding processes. Electrical connections within the insulative polymeric bodies of the described components may be established by placing metal contact surfaces appropriately located and secured within the mold before introduction of the thermoplastic.

What is claimed is:

1. A USB port for a motor vehicle comprising a barrel sized and adapted to fit within an opening sized for a receptacle of a vehicle cigarette lighter;

an electrical connection coupled to computer hardware of the motor vehicle; and a female USB connector sized and adapted to fit within the barrel, wherein the female USB connector is configured to transfer data, the female USB connector configured to slidably couple to the electrical connection.

2. The USB port of claim 1, wherein the lighter opening is located in a dashboard.

3. The USB port of claim 1, wherein the lighter opening is located within a console.

4. The USB port of claim 1 wherein the female USB connector provides access by peripheral equipment to a function selected from the group consisting of engine control, emissions control, power train, automatic braking system, air bag deployment, real-time maintenance data, stored maintenance data, wireless internet access, worksite design data, worksite graphical depictions and global positioning.

5. The USB port of claim 1, wherein the female USB connector is replaceable within the barrel.

6. The USB port of claim 1, wherein the female USB connector provides support for a male USB plug within a cavity of the female connector.

7. The USB port of claim 1, wherein the USB connector is at least partially located within the opening.

8. The USB port of claim 1, wherein the female USB connector is configured to transfer data between the vehicle and a peripheral device.

9. The USB port of claim 1, wherein the barrel replaces the receptacle of the vehicle cigarette lighter within the opening.

10. The USB port of claim 9, wherein the barrel fits within the opening without modification of the opening.

11. A motor vehicle comprising:

a motor vehicle including hardware and a dashboard, the dashboard defining a dashboard opening, a barrel located within the dashboard opening, the barrel including a threaded exterior surface, the barrel defining a cavity, a nut including a threaded interior surface, the nut having a greater diameter than the dashboard opening, the nut engaging the exterior surface and abutting the dashboard, a connection coupled to the hardware, and a USB connector coupled to the connection, the USB connector at least partially located within the cavity.

12. The motor vehicle of claim 11, further comprising a retainer clip fitting over the USB connector.

13. The motor vehicle of claim 12, wherein the retainer clip includes a biased catch, wherein the barrel defines an aperture, the biased catch oriented to connect to the aperture.

14. The motor vehicle of claim 11, further comprising an electrical path through the cavity.

15. The motor vehicle of claim 14, wherein the electrical path includes the USB connector, the connection and the hardware.

16. A USB port for use with a dashboard opening of a motor vehicle, the USB port comprising:

a barrel located within the dashboard opening, the barrel including a flanged first end, a second end, and a threaded exterior surface, the flanged first end having a greater diameter than the dashboard opening, the flanged first end abutting the dashboard, the flanged first end defining a first barrel opening, the second end located behind the dashboard, the second end defining a second barrel opening, the barrel defining a cavity, the cavity in fluid communication with the first and second barrel openings, the cavity and the barrel openings having substantially the same diameter, and a USB connector at least partially located within the cavity.

17. The USB port of claim 16, further comprising an electrical path located in the first barrel opening, the cavity and the second barrel opening.

18. The USB port of claim 17, wherein all electrical paths pass through the second barrel opening.

19. The USB port of claim 17, wherein the electrical path is spaced apart from the barrel.

20. The USB port of claim 17, further comprising hardware coupled to the motor vehicle, a connection coupled to the hardware, the connection including connection pins, and wherein the electrical path includes the USB connector, the connection and the hardware.

* * * * *